US011945999B2

(12) United States Patent
Mondkar et al.

(10) Patent No.: US 11,945,999 B2
(45) Date of Patent: Apr. 2, 2024

(54) HYDROGEN SULPHIDE AND MERCAPTANS SCAVENGING COMPOSITIONS

(71) Applicant: TOTAL MARKETING SERVICES, Puteaux (FR)

(72) Inventors: Hemant Surendra Mondkar, Maharashtra (IN); Frédéric Tort, Brignais (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 17/297,560

(22) PCT Filed: Dec. 4, 2019

(86) PCT No.: PCT/EP2019/083683
§ 371 (c)(1),
(2) Date: May 27, 2021

(87) PCT Pub. No.: WO2020/115135
PCT Pub. Date: Jun. 11, 2020

(65) Prior Publication Data

US 2021/0395618 A1 Dec. 23, 2021

(30) Foreign Application Priority Data

Dec. 4, 2018 (IN) ..... 201841045741
Jan. 17, 2019 (EP) ..... 19305062

(51) Int. Cl.

| | |
|---|---|
| ***C10L 1/222*** | (2006.01) |
| ***C10G 29/20*** | (2006.01) |
| ***C10L 1/224*** | (2006.01) |
| ***C10L 1/233*** | (2006.01) |
| ***C10L 3/10*** | (2006.01) |

(52) U.S. Cl.
CPC ..... *C10G 29/20* (2013.01); *C10L 1/224* (2013.01); *C10L 1/233* (2013.01); *C10L 3/103* (2013.01); *C10G 2300/202* (2013.01)

(58) Field of Classification Search
CPC ..... C10L 1/222; C10L 1/224; C10L 1/233; C10L 3/103
See application file for complete search history.

(56) References Cited

U.S. PATENT DOCUMENTS

| | | | | |
|---|---|---|---|---|
| 4,569,766 | A | 2/1986 | Kool | |
| 5,698,171 | A * | 12/1997 | Trauffer | B01D 53/52 423/220 |
| 6,117,310 | A | 9/2000 | Rivers | |
| 6,786,940 | B1 * | 9/2004 | Wenderoth | C10L 1/143 44/418 |
| 8,187,345 | B2 * | 5/2012 | Eisenbeis | C10L 1/143 44/418 |
| 9,981,958 | B2 * | 5/2018 | Zamudio Rivera | C07D 413/06 |
| 2013/0004393 | A1 * | 1/2013 | Menendez | B01D 53/52 210/749 |
| 2015/0151240 | A1 | 6/2015 | Laroche | |
| 2016/0175769 | A1 * | 6/2016 | Kamoun | B01D 53/52 252/189 |
| 2017/0121443 | A1 | 5/2017 | Reddy | |
| 2018/0371334 | A1 | 12/2018 | Beilfuss | |
| 2020/0109329 | A1 | 4/2020 | De Oliveira Filho et al. | |

FOREIGN PATENT DOCUMENTS

| | | | | |
|---|---|---|---|---|
| FR | 3057877 | | 4/2018 | |
| RU | 1786041 | | 1/1993 | |
| RU | 2290427 | | 12/2006 | |
| RU | 2418036 | | 5/2010 | |
| RU | 2510615 | | 5/2011 | |
| WO | WO1998002501 | A1 * | 1/1998 | C10G 29/20 |
| WO | WO-0023541 | A1 * | 4/2000 | C10L 1/143 |

* cited by examiner

*Primary Examiner* — Ellen M McAvoy
*Assistant Examiner* — Ming Cheung Po
(74) *Attorney, Agent, or Firm* — DUANE MORRIS LLP; Gregory M. Lefkowitz; Brandon A. Chan

(57) ABSTRACT

The present invention relates to a composition for scavenging hydrogen sulphide and/or mercaptans in hydrocarbon streams, the composition comprising an oxazolidine compound and a synergistic additive.

14 Claims, No Drawings

HYDROGEN SULPHIDE AND MERCAPTANS SCAVENGING COMPOSITIONS

CROSS-REFERENCE TO RELATED APPLICATIONS

This application is a § 371 national stage entry of International Application No. PCT/EP2019/083683, filed Dec. 4, 2019, which claims priority to Indian Patent Application No. 201841045741, filed Dec. 4, 2018, and European Patent Application No. 19305062.2, filed Jan. 17, 2019, the entire contents of which are incorporated herein by reference.

TECHNICAL FIELD

The present invention pertains to a novel hydrogen sulphide and mercaptans scavenging composition comprising an oxazolidine compound and a specific additive. The present invention also pertains to the use of the additive to improve the efficiency of an oxazolidine compound for scavenging hydrogen sulphide and mercaptans in hydrocarbon streams. The present invention also relates to a method for scavenging hydrogen sulphide and/or mercaptans comprising contacting a hydrocarbon stream such as crude oil, fuel or natural gas with the scavenging composition of the invention.

BACKGROUND OF THE INVENTION

Hydrogen sulphide is a colourless and fairly toxic, flammable and corrosive gas which also has a characteristic odour at a very low concentration. Hydrogen sulphide dissolves in hydrocarbon and water streams and is also found in the vapour phase above these streams and in natural gas. The hydrogen sulphide emissions can therefore be a nuisance to workers operating in the drilling, production, transport, storage, and processing of crude oil and in the storage of fuel. Hydrogen sulphide may also react with hydrocarbon components present in fuel. It would therefore be desirable for the workers' comfort and safety to reduce or even eliminate the hydrogen sulphide emissions during the manipulation of said products.

Legislation has been in place for years, imposing strict regulations on hydrogen sulphide levels of hydrocarbon streams pipelines, and in storage and shipping containers. A variety of chemical scavengers are available to reduce both the concentration and corresponding hazard of hydrogen sulphide in produced gas, crude oil and refined products. Some of the most common methods for treating hydrogen sulphide include triazine, glyoxal, as well as metal-based scavengers. Glyoxal has been used extensively as hydrogen sulphide scavenger but suffers from a major drawback since aqueous glyoxal solutions are highly corrosive and cannot be used for a gas tower application. Triazines have recently become a more common chemical scavenger used for treating hydrogen sulphide from hydrocarbon streams. However, many drawbacks are reported that are linked to the use of triazines.

Others hydrogen sulphide scavengers have been developed, and among them scavengers based on oxazolidine, like 3,3'-methylenebis(5-methyloxazolidine), known as MBO. A method for scavenging hydrogen sulphide from sour hydrocarbon substrates has been described in WO 98/02501. MBO presents the advantage to be less toxic and to create no scales in the conditions where triazine does.

However, this technology requires an important contact time in order to be efficient in sulphur removal and thus involves injection of higher doses.

Formulations of MBO with promoters, also named boosters, have been developed to enhance the efficiency of MBO. For example, WO 2017/102693 describes a composition comprising MBO and one or more additive selected among urea, urea derivatives, amino acids, guanidine, guanidine derivatives or 1,2-diols, said composition being used in the removal of sulphur compounds from process streams.

It would be useful to provide a composition enhancing the $H_2S$ scavenging properties of MBO.

SUMMARY OF THE INVENTION

The present invention relates to a composition for scavenging hydrogen sulphide and mercaptans from hydrocarbon streams, said composition comprising at least an oxazolidine compound and at least an additive comprising at least one reaction product of a poly(C2-20-carboxylic acid) having at least one tertiary amino group with secondary amines.

According to a particular embodiment, the oxazolidine compound is a bisoxazolidine compound.

According to a particular embodiment, the polycarboxylic acid preferably contains at least 3, more preferably 3 to 12, and even more preferably 3 to 5, carboxyl groups.

According to a particular embodiment, the secondary amines are of the formula $HNR_2$, wherein R radicals are independently straight-chain aliphatic radicals, preferably alkyl radicals having from 10 to 30 carbon atoms, preferably from 14 to 24 carbon atoms.

According to a particular embodiment, the composition comprises from 50 to 99% wt of oxazolidine compound(s) and from 1 to 50% wt of said additive(s), based on the total weight of the composition.

According to a particular embodiment, the weight ratio of oxazolidine compound(s) to said additive(s) ranges from 1 to 50, preferably from 2 to 30, more preferably from 4 to 20.

According to a particular embodiment, the composition further comprises a solvent, preferably in an amount ranging from 1 to 80% wt, based on the total weight of the composition.

According to a particular embodiment, the composition comprises:

From 19 to 80% wt of oxazolidine compound(s),

From 1 to 30% wt of said additive(s), and

From 1 to 80% wt of solvent(s), based on the total weight of the composition.

The present invention also relates to a use of the additive defined in any of claims 1 to 8, for improving the efficiency of an oxazolidine compound for scavenging hydrogen sulphide and/or mercaptans in hydrocarbon streams.

The present invention also relates to a hydrocarbon stream comprising hydrocarbons and a composition according to the invention.

According to a particular embodiment, the hydrocarbons are selected from crude oil, fuel oil, fuel, Light Petroleum Gas and natural gas.

The present invention also relates to a method for scavenging hydrogen sulphide and/or mercaptan in hydrocarbon streams, comprising contacting the hydrocarbon stream with the composition according to the invention.

According to a particular embodiment of the method, the weight ratio between hydrogen sulphide contained in the hydrocarbon stream before the step of contacting and the composition ranges from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4.

The composition of the present invention enables to reduce the treat rate, i.e. reduce the amount of MBO necessary to scavenge a given amount of hydrogen sulphide from the sulphur containing stream.

DETAILED DESCRIPTION OF THE INVENTION

The present invention concerns a hydrogen sulphide and mercaptans scavenging composition comprising at least one oxazolidine compound and at least one additive.

According to the present invention, the synergistic additive comprises at least one reaction product of a poly(C2-20-carboxylic acid) having at least one tertiary amino group with one or more secondary amines.

According to a particular embodiment, the oxazolidine compound is selected from bisoxazolidines, i.e. compounds comprising two oxazolidine cycles.

According to a particular embodiment, the oxazolidine compound replies to formula (I):

(I)

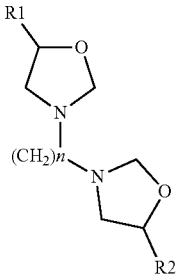

wherein n is an integer ranging from 1 to 6, preferably from 1 to 2;

R1 and R2, identical or different, are selected from a hydrogen atom and a linear, branched or cyclic alkyl or alkenyl groups having from 1 to 6 carbon atoms, preferably from 1 to 2 carbon atoms.

Preferably, the oxazolidine compound is 3,3'-methylenebis(5-methyloxazolidine).

The additive defined in the invention comprises at least one reaction product of a poly(C2-20-carboxylic acid) having at least one tertiary amino group with secondary amines.

Within the meaning of the present invention, the polycarboxylic acid preferably contains at least 3, more preferably 3 to 12, and even more preferably 3 to 5 carboxyl groups. Each carboxyl group in the polycarboxylic acid preferably has 2 to 10 carbon atoms, preferably 2 carbon atoms. The carboxyl groups are linked to the polycarboxylic acid via one or more C and/or N atoms. They are preferably bonded to tertiary nitrogen atoms which, in the case of a plurality of nitrogen atoms, are linked via hydrocarbon chains. Such products can be prepared according to the protocol described in the international application WO 00/23541 and in the U.S. Pat. No. 8,187,345.

The synergistic additive of the invention is preferably an amide, an amidoammonium salt or ammonium salt, or a mixture thereof, of aminoalkanecarboxylic acids of formulae (II) or (III):

(II)

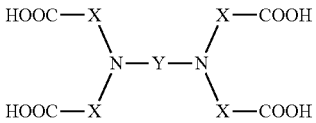

(III)

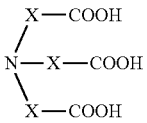

where

X is a radical of 1 to 19 carbon atoms, preferably a C1-19-alkylene radical, particularly preferably C1-10-alkylene, in particular a methylene radical, Y is a straight-chain or branched alkylene of 2 to 6, preferably 2 to 4, more preferably 2 or 3 carbon atoms. Y is preferably an ethylene radical.

The secondary amine may be selected from amines which carry hydrocarbon radicals which may be bonded to one another.

The secondary amine is preferably of the formula $HNR_2$, where radicals R independently are straight-chain aliphatic radicals, in particular alkyl of 10 to 30, preferably 14 to 24, carbon atoms. They preferably have no hetero atoms or double or triple bonds. Preferably, the radicals R are identical, which means that the secondary amines reacting with the poly(C2-20-carboxylic acid) are all identical.

The secondary amines can be bonded by means of amide structures or in the form of their ammonium salts to the polycarboxylic acid, also partly by means of amide structures and partly in the form of the ammonium salts. Preferably, little or no free acid groups are present in the additive used in the invention.

Preferably, the amines are bonded completely in the form of the amide structures.

The amides or amidoammonium salts or ammonium salts of, for example, nitrilotriacetic acid, ethylenediamine-tetraacetic acid or 1,2-propylenediaminetetraacetic acid, are obtained by reacting the acids with from 0.5 to 1.5, preferably from 0.8 to 1.2, mol of amine group per mol of carboxyl group.

According to a particular embodiment, the additive used in combination with the oxazolidine compound is a mixture of 2,2',2",2'"-(ethylenedinitrilotetrakis-N,N-di(C16)alkylacetamide and 2,2',2",2'"-(ethylenedinitrilotetrakis-N,N-di(C18)alkylacetamide.

According to an embodiment, the $H_2S$ and mercaptans scavenging composition comprises from 50 to 99% wt, preferably from 55 to 98% wt, more preferably from 60 to 95% wt, even more preferably from 70 to 90% wt of oxazolidine compound(s) and from 0.5 to 50% wt, preferably from 1 to 45% wt, even more preferably from 1.5 to 40% wt, more preferably from 2 to 30% wt of synergistic additive(s), based on the total weight of the $H_2S$ and mercaptans scavenging composition. Preferably, the weight ratio of oxazolidine compound(s) to synergistic additive(s) ranges from 1 to 100, preferably from 1 to 50, more preferably from 2 to 30, even more preferably from 4 to 20.

According to an embodiment, the $H_2S$ and mercaptans scavenging composition further comprises at least one solvent.

Preferably, the solvent is selected from poly alkyl ethers, aliphatic or aromatic solvents, such as N-methylpyrrolidone, butyl carbitol, xylene, toluene, and benzene. It has been observed that the scavenging efficiency of the compositions of the invention is not dependent on the solvent. However, depending on the final use of the scavenging composition, a solvent having a dual solubility, i.e. a water solubility and a solubility in hydrocarbons, can be preferred. Butyl carbitol is a suitable solvent since it has this dual solubility.

According to this embodiment, the solvent represents from 1 to 80% of the composition, preferably from 5 to 70% wt, more preferably from 10 to 60% wt, even more preferably from 20 to 50% wt of the composition.

According to a particular embodiment of the invention, the composition comprises:

From 10 to 98% wt, preferably from 30 to 80% wt, more preferably from 40 to 60% wt of oxazolidine compound(s), From 0.5 to 30% wt, preferably from 1 to 20% wt, more preferably from 2 to 15% wt, even more preferably from 3 to 10% wt of the additive(s) defined in the invention, and From 1.5 to 80% wt, preferably from 5 to 65% wt, more preferably from 15 to 55% wt of solvent(s), based on the total weight of the composition.

According to a particular embodiment of the invention, the composition comprises:

From 19 to 80% wt, preferably from 30 to 70% wt, more preferably from 40 to 60% wt of oxazolidine compound(s), From 1 to 30% wt, preferably from 1.5 to 20% wt, more preferably from 2 to 10% wt of the additive(s) defined in the present invention, and From 1 to 80% wt, preferably from 15 to 65% wt, more preferably from 25 to 55% wt of solvent(s), based on the total weight of the composition.

According to an embodiment of the invention, the composition comprises:

From 19 to 80% wt, preferably from 30 to 70% wt, more preferably from 40 to 60% wt of a bisoxazolidine, From 1 to 30% wt, preferably from 1.5 to 20% wt, more preferably from 2 to 10% wt of additive(s) selected from reaction products of a poly(C2-12-carboxylic acid) having at least three carboxyl groups and at least one tertiary amino group with secondary amines of formula $HNR_2$, where radicals R independently are straight-chain aliphatic radicals having from 10 to 30 carbon atoms, and From 1 to 80% wt, preferably from 15 to 65% wt, more preferably from 25 to 55% wt of solvent(s), based on the total weight of the composition.

According to an embodiment of the invention, the composition comprises:

From 10 to 98% wt, preferably from 30 to 80% wt, more preferably from 40 to 60% wt of bisoxazolidine compound(s), From 0.5 to 30% wt, preferably from 1 to 20% wt, more preferably from 2 to 15% wt, even more preferably from 3 to 10% wt of the additive(s) defined in the invention, and From 1.5 to 80% wt, preferably from 5 to 65% wt, more preferably from 15 to 55% wt of solvent(s), based on the total weight of the composition, wherein the additive(s) are selected from reaction products of a poly(C2-12-carboxylic acid) having at least three carboxyl groups and at least one tertiary amino group with secondary amines of formula $HNR_2$, where radicals R independently are straight-chain aliphatic radicals having from 10 to 30 carbon atoms.

The present invention also concerns the use of the synergistic additive defined above for improving the efficiency of the oxazolidine compound defined above for scavenging hydrogen sulphide ($H_2S$) and/or mercaptans in hydrocarbon streams.

By hydrocarbon stream is meant either a single-phase hydrocarbon stream or a multiphase system comprising oil/water or oil/water/gas or gas/water.

Preferably, the weight ratio oxazolidine compound(s) to synergistic additive(s) ranges from 1 to 50, preferably from 2 to 30, preferably from 4 to 20.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

The present invention also concerns the use of the composition defined above as a $H_2S$ and/or mercaptans scavenger in hydrocarbon streams, said hydrocarbon streams being preferably selected from crude oil, fuel and natural gas. The composition of the invention is contacted with hydrocarbon streams such as crude oil, fuel or natural gas in order to reduce the amount of hydrogen sulphide ($H_2S$) and mercaptans.

Hydrocarbon streams may be selected from crude oils and fuels which typically comprise more than 60% wt of paraffins, preferably more than 70% wt of paraffins and even more preferably more than 75% wt of paraffins, based on the total weight of the crude oils and fuels. Hence, hydrocarbon streams may be selected from crude oils and fuels which typically comprise less than 30% wt of aromatics, preferably less than 10% wt of aromatics and even more preferably less than 5% wt of aromatics, based on the total weight of the crude oils and fuels.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

According to an embodiment of the present invention, the weight ratio $H_2S$:scavenging composition ranges from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4. In this ratio, $H_2S$ represents the amount of hydrogen sulphide in the hydrocarbon streams, before contacting with the scavenging composition of the invention.

The present invention also concerns hydrocarbon streams comprising hydrocarbons and the composition of the invention. The hydrocarbon streams considered in the present invention may be either single-phase hydrocarbon streams or multiphase systems comprising oil/water or oil/water/gas or gas/water.

Hydrocarbons may be selected from crude oil, fuel oil, fuel, Light Petroleum Gas and natural gas. Hydrocarbon streams may be selected from crude oils and fuels which typically comprise more than 60% wt of paraffins, preferably more than 70% wt of paraffins and even more preferably more than 75% wt of paraffins, based on the total weight of the crude oils and fuels. Hence, hydrocarbon streams may be selected from crude oils and fuels which typically comprise less than 30% wt of aromatics, preferably less than 10% wt of aromatics and even more preferably less than 5% wt of aromatics, based on the total weight of the crude oils and fuels.

Hydrocarbon streams contain $H_2S$ and/or mercaptans, in an amount for example ranging from 1 to 10 000 ppm.

Mercaptans that can be removed from hydrocarbon streams within the framework of the present invention may be $C_1$-$C_6$ mercaptans, such as $C_1$-$C_4$ mercaptans.

The composition of the invention may represent from 0.0005 to 5% by weight of the total weight of the hydrocarbon streams.

According to an embodiment of the present invention, the weight ratio $H_2S$:scavenging composition ranges from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4. In this ratio, $H_2S$ represents the amount of hydrogen sulphide of the hydrocarbon streams, before contacting with the scavenging composition of the invention.

EXAMPLES

The invention is now described with the help of following examples, which are not intended to limit scope of the present invention, but are incorporated to illustrate advantages of the present invention and best mode to perform it. The following examples also demonstrated effectiveness of scavenging compositions of present invention, which can be a composition comprising of MBO (3,3'-methylenebis(5-methyloxazolidine) and reaction products of a polycarboxylic acid and secondary amines.

Example 1: Protocol of Experiment for the Measurement of $H_2S$ Scavenging Ability of the Scavenging Compositions Under Modified ASTM D-5705 Conditions ASTM D-5705 is recommended for measurement of Hydrogen sulfide in a vapor phase above the residual fuel oils. Performance evaluation of the various products and formulations developed as Hydrogen Sulfide Scavengers were evaluated using modified ASTM D-5705 test method.

In a typical experiment, 1 liter tin metal bottles with inner and outer caps were used to prepare and hold the test media. Dearomatized hydrocarbon solvents (with high boiling range i.e. >120° C. and flash point above 65° C. with aromatic content less than 0.1%) is used for the tests.

In a representative experimental set, a defined amount of $H_2S$ saturated hydrocarbon solvent, typically between 2000 and 7000 ppm by weight of $H_2S$, was inserted in a well-sealed plastic drum containing 10 liters of dearomatized hydrocarbon solvent. The plastic drum was then kept on a reciprocating shaking machine for 5 min to allow proper mixing of the $H_2S$ gas. 500 mL of the $H_2S$ containing dearomatized hydrocarbon solvent were then transferred to first tin metal bottle and sealed with inner and outer caps. The tin metal bottle was then kept in a water bath at 60° C. for two hours. After two hours, the tin metal bottle was taken out and cooled down to room temperature under running tap water and kept aside. An $H_2S$ detecting tube (Drager tube, with typical detection limit ranging from 100 to 70 000 ppm by weight) was inserted in a rubber cork through a hole having the same diameter as the detecting tube. The sealed ends of the $H_2S$ detecting tube were opened with an appropriate opener, one end of the tube being attached to Drager pump. The inner and outer caps of the tin metal bottles were opened and very quickly the rubber cork with $H_2S$ detector tube was inserted inside the opening of the tin metal bottle. The $H_2S$ gas in the vapor phase of the tin metal bottle was then pulled through the $H_2S$ measuring tube using Drager pump attached at the other end of the tube. The detector tube was removed after complete decompression of the pump. $H_2S$ concentration was read from the tubes calibration scale (typically color change from colorless to brown). This reading was noted as a reference Blank reading of $H_2S$ amount.

Further, remaining $H_2S$ containing dearomatized hydrocarbon solvent was transferred into other tin metal bottles, each with 500 mL of the dearomatized hydrocarbon, all bottles being pre-charged with the $H_2S$ scavengers at different ratios of scavenger against $H_2S$, based on the Blank reading. Typical $H_2S$:scavenger ratios employed were 1:1, 1:0.8, 1:0.6, 1:0.4, 1:0.2 and 1:0.1. All the metal bottles were kept in a water bath for two hours at 60° C. Similar protocol was employed to measure the $H_2S$ in the vapor phase of all the bottles as used to make the Blank reading. The difference between the Blank $H_2S$ concentration and $H_2S$ concentration observed with different concentrations of the scavenging products and formulations are noted as % scavenging. A higher % Scavenging with lower concentration of the scavenging product is considered as better $H_2S$ scavenger for the set of experiment.

The protocol of measurement was repeated three times with each scavenging composition and the indicated percentage was calculated based on the average of the measurements.

Example 2: Measurement of $H_2S$ Scavenging Ability of the Scavenging Compositions of the Invention Under Modified ASTM D-5705 Conditions, as Detailed in Example 1

Table 1 below summarizes the scavenging compositions that were tested. The synergistic additive used in Examples I1, I2 and I3 according to the invention was a mixture of 2,2',2",2'"-(ethylenedinitrilotetrakis-N,N-di(C16)alkylacetamide and 2,2',2",2'"-(ethylenedinitrilotetrakis-N,N-di(C18) alkylacetamide. This product mixture is available from BASF under the commercial names Keroflux® 3614 and Keroflux® 3241. A sample of Keroflux® 3614 was used in the following examples. This product is commercialized in the form of a solution with an active content of about 40 to 50% w/w, i.e. comprising 40-50 wt % additive and 50-60 wt % solvent. The concentration of additive reported in Table 1 corresponds to the actual amount of active ingredient in the scavenging composition. As such, composition I1 comprises 10 wt % of additive solution at 40-50%, which correspond to 4-5 wt % of active ingredient in the scavenging composition.

TABLE 1 scavenging compositions (in wt % based on the total weight of the composition)

| $H_2S$ scavenging composition | MBO (wt %) | Synergistic additive (wt % of active ingredient) Keroflux ® 3614 | Solvent (wt %) xylene |
|---|---|---|---|
| C1 (comparative) | 50 | 0 | 50 |
| C2 (comparative) | 100 | 0 | 0 |
| I1 | 50 | 4-5 | 45-46 |
| I2 | 50 | 2-2.5 | 47.5-48 |
| I3 | 45 | 2-2.5 | 52.5-53 |

Table 2 below shows the percentage of $H_2S$ reduction based on the measured $H_2S$ amount in vapour phase after treatment with comparative MBO compositions (C1 and C2) and $H_2S$ scavenging compositions of the invention (I1, I2 and I3).

TABLE 2

| Scavenging efficiency (% of $H_2S$ reduction) of the scavenging compositions | | | | | | | |
|---|---|---|---|---|---|---|---|
| $H_2S$ scavenging composition | Sample 1 (blank) | Sample 2 [1:0.1] | Sample 3 [1:0.2] | Sample 4 [1:0.4] | Sample 5 [1:0.6] | Sample 6 [1:0.8] | Sample 7 [1:1] |
| C1 (50% MBO) | 0 | 3 | 12 | 43 | 74 | 92 | 100 |
| C2 (100% MBO) | 0 | 15 | 45 | 93 | 100 | 100 | 100 |
| I1 (50% MBO; 4-5% additive) | 0 | 30 | 60 | 100 | 100 | 100 | 100 |
| I2 (50% MBO; 2-2.5% additive) | 0 | 32 | 75 | 90 | 100 | 100 | 100 |
| I3 (45% MBO; 2-2.5% addtive) | 0 | 17 | 50 | 83 | 100 | 100 | 100 |

The results in Table 2 clearly show that the scavenging compositions of the present invention are much more efficient than the scavenging compositions of the prior art.

If we refer for example to sample 4 wherein the weight ratio $H_2S$:scavenging composition is 1:0.4, we can observe that 100% of the $H_2S$ have been scavenged with the scavenging composition I1 according to the invention and even 90% of the $H_2S$ with the scavenging composition I2 comprising twice less additive than 11, whereas only 43% of the $H_2S$ have been scavenged with the scavenging composition C1 of prior art.

Example 3: Measurement of $H_2S$ Scavenging Ability of the Synergistic Additive of the Invention Under ASTM D-5705 Conditions, as Detailed in Example 1

The synergistic additive of the invention was also tested alone for its ability to scavenge hydrogen sulphide using the modified ASTM D-5705 method. The aim was to determine the contribution of the synergistic additive to the total scavenging ability of the composition.

The protocol of measurement was repeated three times with each composition of synergistic additive and the indicated percentage was calculated based on the average of the measurements.

Table 3 below shows the percentage of $H_2S$ reduction based on the measured $H_2S$ amount in vapour phase after treatment with the additive in a solvent. The tested comparative composition C3 comprises 5% by weight of active ingredient of the additive Keroflux® 3614 and 95% by weight of xylene. Similarly C4 comprise 10% by weight of active ingredient of the additive Keroflux® 3614 and 90% by weight of xylene.

TABLE 3

| % Scavenging efficiency (% of $H_2S$ reduction) of the additive | | | | | | | |
|---|---|---|---|---|---|---|---|
| synergistic additive composition | Sample 1 (blank) | Sample 2 [1:0.1] | Sample 3 [1:0.2] | Sample 4 [1:0.4] | Sample 5 [1:0.6] | Sample 6 [1:0.8] | Sample 7 [1:1] |
| C3 (5% additive) | 0 | 0 | 0 | 0 | 0 | 0 | 0 |
| C4 (10% additive) | 0 | 0 | 0 | 0 | 0 | 0 | 0 |

The results in Table 3 clearly show that the synergistic additive has no direct effect on the scavenging of hydrogen sulphide. This confirms that said additive cannot itself scavenge $H_2S$ but has a boosting effect when used together with an $H_2S$ scavenging compound.

Example 4: Measurement of $H_2S$ Scavenging Ability of the Scavenging Compositions of the Invention Under Modified ASTM D-5705 Conditions The following protocol has been followed:

ASTM D-5705 is recommended for measurement of Hydrogen sulfide in a vapor phase above the residual fuel oils. Performance evaluation of the various products and formulations developed as Hydrogen Sulfide Scavengers were evaluated using modified ASTM D-5705 test method.

In a typical experiment, 1 liter tin metal bottles with silicon septa were used to prepare and hold in the two test media:

Test media 1: a dearomatized hydrocarbon solvent having an initial boiling point higher than 120° C., a final boiling point lower than 250° C. (the difference between the final boiling point and the initial boiling point ranges from 20 to 35° C.) and a flash point above 65° C. with aromatic content less than 0.1% wt and a paraffin content of more than 75% wt, Test media 2: a dearomatized hydrocarbon solvent having an initial boiling point higher than 120° C., a final boiling point higher than 250° C. (the difference between the final boiling point and the initial boiling point ranges from 40 to 50° C.) and a flash point above 100° C. with aromatic content less than 0.05% wt and a paraffin content of more than 75% wt.

In a representative experimental set, a defined amount of $H_2S$ saturated hydrocarbon solvent, typically between 2000 and 7000 ppm by weight of $H_2S$, was injected in 1 liter tin metal bottle pre-filled with 500 ml of dearomatized hydrocarbon solvent through the silicon septa fixed at the opening of the bottle using micro-syringe. The metal bottle was then kept on a reciprocating shaking machine for 5 min to allow proper mixing of the $H_2S$ gas. The tin metal bottle was then kept in a water bath at 60° C. for two hours. After two hours, the tin metal bottle was taken out and cooled down to room temperature under running tap water and kept aside. An $H_2S$ detecting tube (Drager tube, with typical detection limit ranging from 100 to 70 000 ppm by weight) was inserted in a rubber cork through a hole having the same diameter as the detecting tube. The sealed ends of the $H_2S$ detecting tube were opened with an appropriate opener, one end of the tube being attached to Drager pump. The silicon septa mounted at the opening of the tin metal bottles was removed and very quickly the rubber cork with $H_2S$ detector tube was inserted inside the opening of the tin metal bottle. The $H_2S$ gas in the vapor phase of the tin metal bottle was then pulled through the $H_2S$ measuring tube using Drager pump attached at the other end of the tube. The detector tube was removed after complete decompression of the pump. $H_2S$ concentration was read from the tubes calibration scale (typically color change from colorless to brown). This reading was noted as a reference Blank reading of $H_2S$ amount.

TABLE 4 scavenging compositions (in wt % based on the total weight of the composition)

| $H_2S$ scavenging composition | MBO (wt %) | Synergistic additive (wt % of active ingredient) Keroflux ® 3614 | Solvent (wt %) Butyl carbitol |
|---|---|---|---|
| C5 | 50 | 0 | 50 |
| I4 | 50 | 2.25-2.75 | 47.25-47.75 |
| I5 | 50 | 1.13-1.38 | 48.87-48.62 |
| I6 | 50 | 0.45-0.55 | 49.55-49.45 |

Table 5 below shows the percentage of $H_2S$ reduction based on the measured $H_2S$ amount in vapour phase after treatment with a comparative MBO composition (C5) and $H_2S$ scavenging compositions of the invention (14, 15 and 16).

TABLE 5

Scavenging efficiency (% of $H_2S$ reduction) of the scavenging compositions

| $H_2S$ scavenging composition in Test media | Sample 1 (blank) | Sample 2 [1:0.1] | Sample 3 [1:0.2] | Sample 4 [1:0.4] | Sample 5 [1:0.6] | Sample 6 [1:0.8] | Sample 7 [1:1] |
|---|---|---|---|---|---|---|---|
| C5 in Test Media 1 | 0 | 5 | 12 | 43 | 74 | 92 | 100 |
| C5 in Test Media 2 | 0 | 10 | 26 | 78 | 85 | 100 | 100 |
| I4 in Test Media 1 | 0 | 40 | 60 | 100 | 100 | 100 | 100 |
| I4 in Test Media 2 | 0 | 42 | 66 | 100 | 100 | 100 | 100 |
| I5 in Test Media 1 | 0 | 32 | 75 | 90 | 100 | 100 | 100 |
| I6 in Test Media 1 | 0 | 32 | 52 | 72 | 100 | 100 | 100 |

Further, same amount of $H_2S$ containing dearomatized hydrocarbon solvent was injected into other tin metal bottles, which are pre-filled with 500 mL of the dearomatized hydrocarbon, and $H_2S$ scavengers at different ratios of scavenger against $H_2S$, based on the Blank reading. Typical $H_2S$:scavenger ratios employed were 1:1, 1:0.8, 1:0.6, 1:0.4, 1:0.2 and 1:0.1. All the metal bottles were kept in a water bath for two hours at 60° C. Similar protocol was employed to measure the $H_2S$ in the vapor phase of all the bottles as used to make the Blank reading. The difference between the Blank $H_2S$ concentration and $H_2S$ concentration observed with different concentrations of the scavenging products and formulations are noted as % scavenging. A higher % Scavenging with lower concentration of the scavenging product is considered as better $H_2S$ scavenger for the set of experiment.

The protocol of measurement was repeated three times with each scavenging composition and the indicated percentage was calculated based on the average of the measurements.

Table 4 below summarizes the scavenging compositions that have been tested. The synergistic additive used in Examples I4, I5 and I6 is identical to the additive used in example 2, except that the solvent xylene has been replaced by the solvent butyl carbitol. The concentration of additive reported in Table 4 corresponds to the actual amount of active ingredient in the scavenging composition. As such, composition I4 comprises 5 wt % of additive solution at 45-55 wt % of active content, which correspond to 2.25-2.75 wt % of active ingredient in the scavenging composition.

The results in Table 5 clearly show that the scavenging compositions of the present invention are much more efficient than the scavenging compositions of the prior art, in both hydrocarbon streams that have been used as test media.

The invention claimed is:

1. A composition for scavenging hydrogen sulphide and mercaptans from hydrocarbon streams, said composition comprising at least an oxazolidine compound and at least an additive comprising at least one reaction product of a poly(C2-20-carboxylic acid) having at least one tertiary amino group with secondary amines, wherein the composition comprises from 50 to 99% wt of oxazolidine compound(s) and from 1 to 50% wt of said additive(s), based on the total weight of the composition, wherein the oxazolidine compound is a bisoxazolidine compound, wherein the oxazolidine compound has a structure of formula (I):

(I)

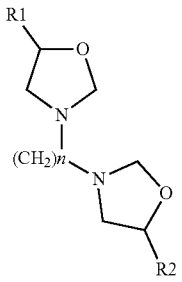

wherein n is an integer ranging from 1 to 6;

R1 and R2, identical or different, are selected from a hydrogen atom and a linear, branched or cyclic alkyl or alkenyl groups having from 1 to 6 carbon atoms, and wherein the additive is an amide, an amidoammonium salt or ammonium salt, or a mixture thereof, of aminoalkanecarboxylic acids of formulae (II) or (III):

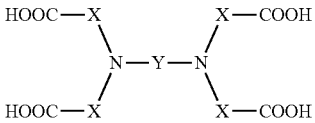

(II)

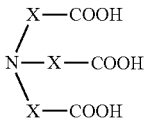

(III)

where

X is a radical of 1 to 19 carbon atoms, and

Y is a straight-chain or branched alkylene of 2 to 6 carbon atoms.

2. The composition according to claim 1, wherein the weight ratio of bisoxazolidine compound(s) to said additive(s) ranges from 1 to 100.

3. The composition according to claim 1, further comprising a solvent.

4. The composition according to claim 3, wherein the solvent is present in an amount ranging from 1 to 80% wt, based on the total weight of the composition.

5. The composition according to claim 1, comprising:

From 19 to 80% wt of bisoxazolidine compound(s),

From 1 to 30% wt of said additive(s), and

From 1 to 80% wt of solvent(s), based on the total weight of the composition.

6. Process for improving the efficiency of a bisoxazolidine compound for scavenging hydrogen sulphide and/or mercaptans in hydrocarbon streams, the process comprising a step of adding the additive defined in claim 1 in a bisoxazolidine compound.

7. Hydrocarbon stream comprising hydrocarbons and a composition according to claim 1.

8. Hydrocarbon stream according to claim 7, wherein the hydrocarbons are selected from crude oil, fuel oil, fuel, Light Petroleum Gas and natural gas.

9. A method for scavenging hydrogen sulphide and/or mercaptan in hydrocarbon streams, comprising contacting the hydrocarbon stream with the composition according to claim 1.

10. The method according to claim 9, wherein the weight ratio between hydrogen sulphide contained in the hydrocarbon stream before the step of contacting and the composition ranges from 1:2 to 1:0.05.

11. The composition according to claim 1, wherein the polycarboxylic acid contains 3 to 12 carboxyl groups.

12. The composition according to claim 1, wherein the polycarboxylic acid contains 3 to 5 carboxyl groups.

13. The composition according to claim 1, wherein the secondary amines are of the formula $HNR_2$, wherein R radicals are independently straight-chain alkyl radicals having from 10 to 30 carbon atoms.

14. The composition according to claim 1, wherein the secondary amines are of the formula $HNR_2$, wherein R radicals are independently straight-chain alkyl radicals having from 14 to 24 carbon atoms.

* * * * *